US006938520B1

(12) United States Patent
Stuart

(10) Patent No.: US 6,938,520 B1
(45) Date of Patent: Sep. 6, 2005

(54) BACKUP TONG WITH SWING ARMS

(75) Inventor: Randolph Stuart, Odessa, TX (US)

(73) Assignee: Eckel Manufacturing Co., Inc., Odessa, TX (US)

( * ) Notice: Subject to any disclaimer, the term of this patent is extended or adjusted under 35 U.S.C. 154(b) by 0 days.

(21) Appl. No.: 10/835,368

(22) Filed: Apr. 29, 2004

(51) Int. Cl.[7] ..... B25B 13/50
(52) U.S. Cl. ..... 81/57.34; 81/57.16; 81/57.24
(58) Field of Search ..... 81/57.34, 57.16, 81/57.24, 57.18, 57.35

(56) References Cited

U.S. PATENT DOCUMENTS 4,402,239 A * 9/1983 Mooney ..... 81/57.16
4,574,664 A * 3/1986 Curry ..... 81/57.34
5,702,139 A * 12/1997 Buck ..... 294/88
5,778,742 A * 7/1998 Stuart ..... 81/57.34

* cited by examiner

*Primary Examiner*—David B. Thomas
*Assistant Examiner*—Alvin J Grant
(74) *Attorney, Agent, or Firm*—Browning Bushman P.C.

(57) ABSTRACT

A backup tong 10 secures the tubular against axial rotation in response to rotation by a power tong. The backup tong plate 20 supports a pair fluid powered cylinders 32, 34, and a pair of swing arms 50, 52 each pivotally connected to the respective fluid powered cylinder. A left side cam plate 44 and a right side cam plate 46 are each provided for cooperation with a respective left side and right side cam follower 58, 60. The gripping head 30 provided on the backup tong plate, and a pair of gripping heads 62, 64 are provided on a forward end of each of the swing arms for gripping the tubular. A method of the invention includes supporting the fluid powered cylinders on the backup tong plate, and pivotally connecting the swing arms to the respective fluid powered cylinders. The cam followers move within respective cam plates during actuation of the cylinders.

20 Claims, 9 Drawing Sheets

BACKUP TONG WITH SWING ARMS

FIELD OF THE INVENTION

The present invention relates to backup tongs of the type used for securing a tubular against axial rotation in response to rotation of another tubular by a pipe rotating device, such as a power tong. More particularly, this invention relates to a backup tong with a left side and a right side head each on a swing arm for reduced marking of the tubular.

BACKGROUND OF THE INVENTION

Various types of backup tongs have been devised over the past 50 years, including both manually operated and power operated backup tongs. U.S. Pat. No. 4,574,664 discloses an hydraulically powered backup tong with a pair of hydraulic cylinders which pivot the cage plate to move a pair of heads into an out of gripping engagement with the tubular. U.S. Pat. No. 5,778,742 discloses another version of the backup tong with a pair of hydraulic cylinders which pivot a pair of arms into and out of gripping engagement with the tubular.

Many backup tongs have a geometry which allows for only a narrow set of tubular diameters to be inserted into the open throat of the backup tong. Other backup tongs provide a circumferential combined coverage of the dies which grip the tubular which is significantly restricted, thereby tending to crush the tubular upon gripping and also reducing the friction surface for torque restraint, which tends to mark the tubular. Dies which pivot concentrate reactive forces on the pivot pin, and do not uniformly spread the forces to all dies. Pivoting heads or dies also tend to have alignment problems with the full range of tubular to be gripped by the heads or dies.

Other backup tongs have a design which utilizes a relatively long stroke for the hydraulic cylinders, thereby increasing the overall size of the backup tong. Some backup tongs employ a latching mechanism to close the open throat which is complex and thus costly to manufacture and difficult for an operator to use.

The disadvantages of the prior art were overcome by the present invention, and an improved backup tong and method of securing a tubular against axial rotation is hereinafter disclosed.

SUMMARY OF THE INVENTION

A backup tong is provided for securing a tubular against axial rotation in response to rotation of a mating tubular by a power tong or other pipe rotating device. The backup tong includes a tong plate supporting a left side hydraulic cylinder and a right side hydraulic cylinder, and also a gripping head spaced generally along the centerline of the backup tong plate for gripping the tubular. A left side swing arm and a right side swing arm are each pivotally connected to the respective left side hydraulic cylinder and the right side hydraulic cylinder. A left side cam plate and a right side cam plate are each supported on one of the backup tongs plate and a respective swing arm, while a left side cam follower and a right side cam follower are each supported on the other of the back up tong plate and the swing arm for cooperation with the left side cam plate and the right side cam plate, respectively. A gripping head is provided on a forward end of each swing arm for gripping the tubular.

According to the method of the invention, the left side hydraulic cylinder and the right side hydraulic cylinder are each supported on the backup tong plate, which also supports a gripping head spaced generally along a centerline of the backup tong plate for gripping the tubular. The method includes pivotally connecting the left side swing arm and the right side swing arm to the respective left side hydraulic cylinder and right side hydraulic cylinder. The left side cam plate and the right side cam plate are each supported on one of the backup tong and a respective swing arm, or a left side cam follower and a right side cam follower are each supported on the other of the backup tong plate and the swing arm for cooperation with the left side cam plate and the right side cam plate. The gripping head is positioned on a forward end of each of the left side swing arm and the right side swing arm within the tubular.

It is a feature of the invention that the backup tong plate comprises both an upper backup tong plate and a lower backup tong plate, with each of the left side cylinder and right side cylinder being positioned between the upper backup tong plate and the lower backup tong plate.

It is a further feature of the invention that the left side swing arm and the right side swing arm each comprise an upper swing arm positioned above the backup tong plate and the lower swing arm position below the backup tong plate.

Still another feature of the invention is the inclusive of a latch arm pivotally connected to the backup tong plate and one of the swing arms, with a latch pivotally connected to the latch arm and the swing arm and movable for opening and closing the space between the left side swing arm and the right side swing arm in response to actuation of the cylinders.

In another significant feature of the invention is that the gripping heads on both the backup tong plate and on the left side and the right side swing arm are formed with aluminum dies, which preferably have a knurled surface. This significantly reduces marking of the tubular. The dies preferably engage the tubular over a circumferential length of at least 340°.

Yet another significant feature of the invention is that each of the right side cam plate and the left side cam plate move with their respective cam follower at a direction substantially parallel to the centerline of the backup tong during engagement of the gripping heads with the tubular.

These and further features and advantages of the present invention will become apparent from the following detailed description, and reference is made to the figures in the accompanying drawings.

DETAILED DESCRIPTION OF PREFERRED EMBODIMENTS

Figure 1:
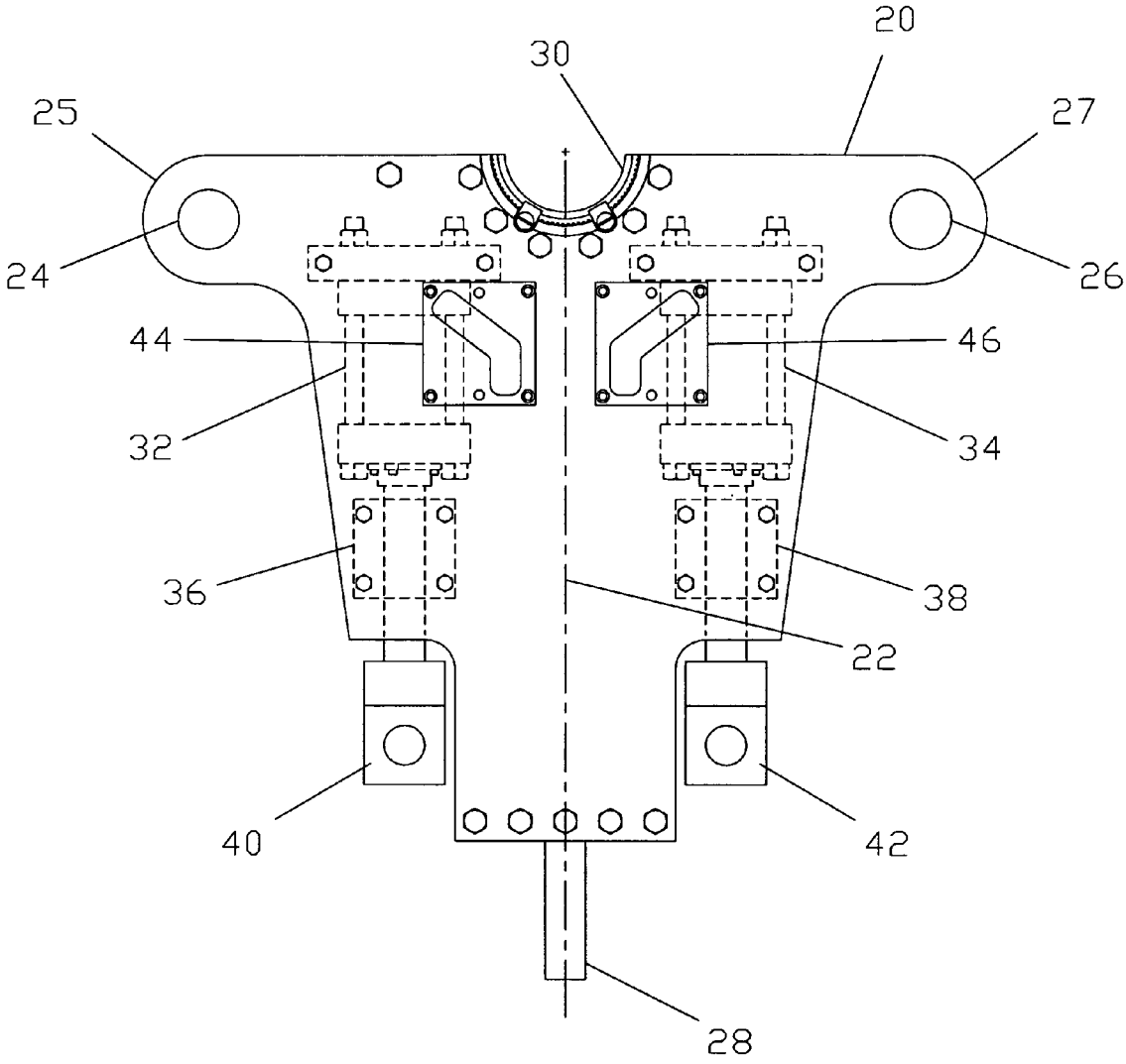
FIG. 1 depicts a top view of a backup tong plate according to the present invention.

FIG. 1 depicts the backup tong plate 20 for a suitable embodiment of the invention, with the backup tong plate having a centerline 22 which is aligned with the centerline of the tubular to be gripped. The left side of the backup tong plate includes a through aperture 24 on an ear 25 extending laterally outward from the centerline 22 of the backup plate, and a similar aperture 26 and an ear 27 extending to the right of the centerline 22. Each of the apertures 24 and 26 may receive a downward extending post or other suitable structure secured to a power tong, thereby mounting the backup to the power tong without restricting rotation. A stinger arm 28 is secured to backup tong plate 20, and may cooperate with a suitable load cell to measure torque exerted by the power tong, as those skilled in the art appreciate. The backup tong plate includes a central head 30 with a aluminum die for gripping engagement with the tubular. The head 30 and thus the die thereon is rigidly mounted on the plate 20, and cooperates with other dies as explained subsequently to grip the tubular. The circumferential length of the dies 30 for gripping the tubular is preferably at least 160°, and in many cases will be at least 170°.

A pair of fluid powered cylinders, such as hydraulic cylinders 32 and 34, are mounted to the tong plate 20 with movement of the cylinder rods being preferably controlled by a suitable cylinder rod support 36, 38 provided for sliding engagement with the cylinder rods. Each cylinder rod terminates in a rearward rod eye 40, 42, which is pivotally connected to a respective swing arm, as explained subsequently. A cam plate 44, 46 is mounted on the left side and the right side of the backup tong plate 20, and the purpose of the cam plates will also be discussed subsequently. Although oil is the preferred fluid for powering the cylinders, other embodiments could be pneumatically powered.

In a preferred embodiment, a pair of substantially identical upper and lower tong plates 20 are provided, with each of the cylinders 32 and 34 being positioned between the upper backup tong plate and the lower backup tong plate. Gripping head 30 may thus be mounted to each of the upper tong plate of the lower tong plate for a more rigid connection to the tong plates.

Figure 2:
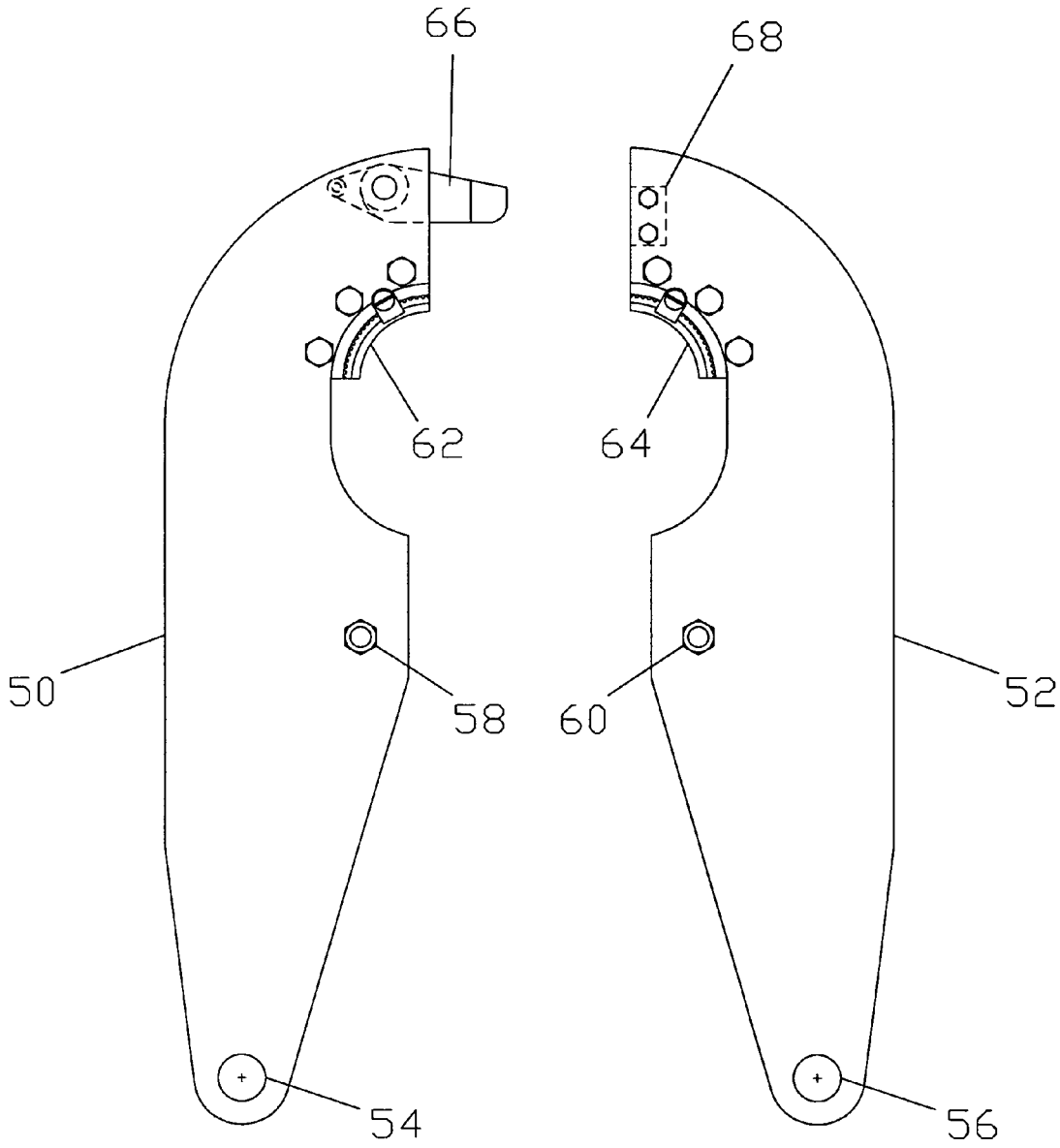
FIG. 2 depicts a top view of both the left side swing arm and the right side swing arm according to the invention.

FIG. 2 depicts a pair of swing arms 50, 52, which are each preferably mirror imagines of each other. A rod 54, 56 on the rearward end of each swing arm may be positioned within the aperture in the rod eye 40, 42, thereby pivotally connecting the rod end of each cylinder with the swing arm. The swing arm 50 further supports a gripping head 62 in the front or forward end of the swing arm, and swing arm 52 supports a similar gripping head 64. Each of the gripping heads 62, 64 similarly has aluminum dies with a knurled surface, and each gripping head 62, 64 preferably has a circumference of at least 80° for engaging the tubular. Aluminum is a relatively inexpensive material for fabricating the dies, and knurling the die gripping surface produces small indentations in the gripping surface which do not tend to mark the tubular being gripped, but do produce an effective gripping surface to prevent rotation between the tubular and the die.

FIG. 2 also depicts mounting bolts 58, 60 which depict the location of cam followers subsequently described, and a pivotal latch 66 mounted to the swing arm 50 for engagement with the latch block 68 to close the open throat of the backup tong when the dies engage the pipe.

A single pair of swing arms pivotally connected to the respective fluid powered cylinder may operate satisfactory for some applications, but a preferred embodiment of a backup tong for many applications includes a combination of upper and lower left side and right side swing arms, so that four swing arms are provided, with two above the backup tong plate and two below the backup tong plate. Moreover, for the embodiment wherein both an upper backup tong plate and a lower backup tong plate are provided, the upper swing arms are provided above the upper backup tong plate, and the lower swing arms are provided below the lower backup tong plate.

Figure 3:
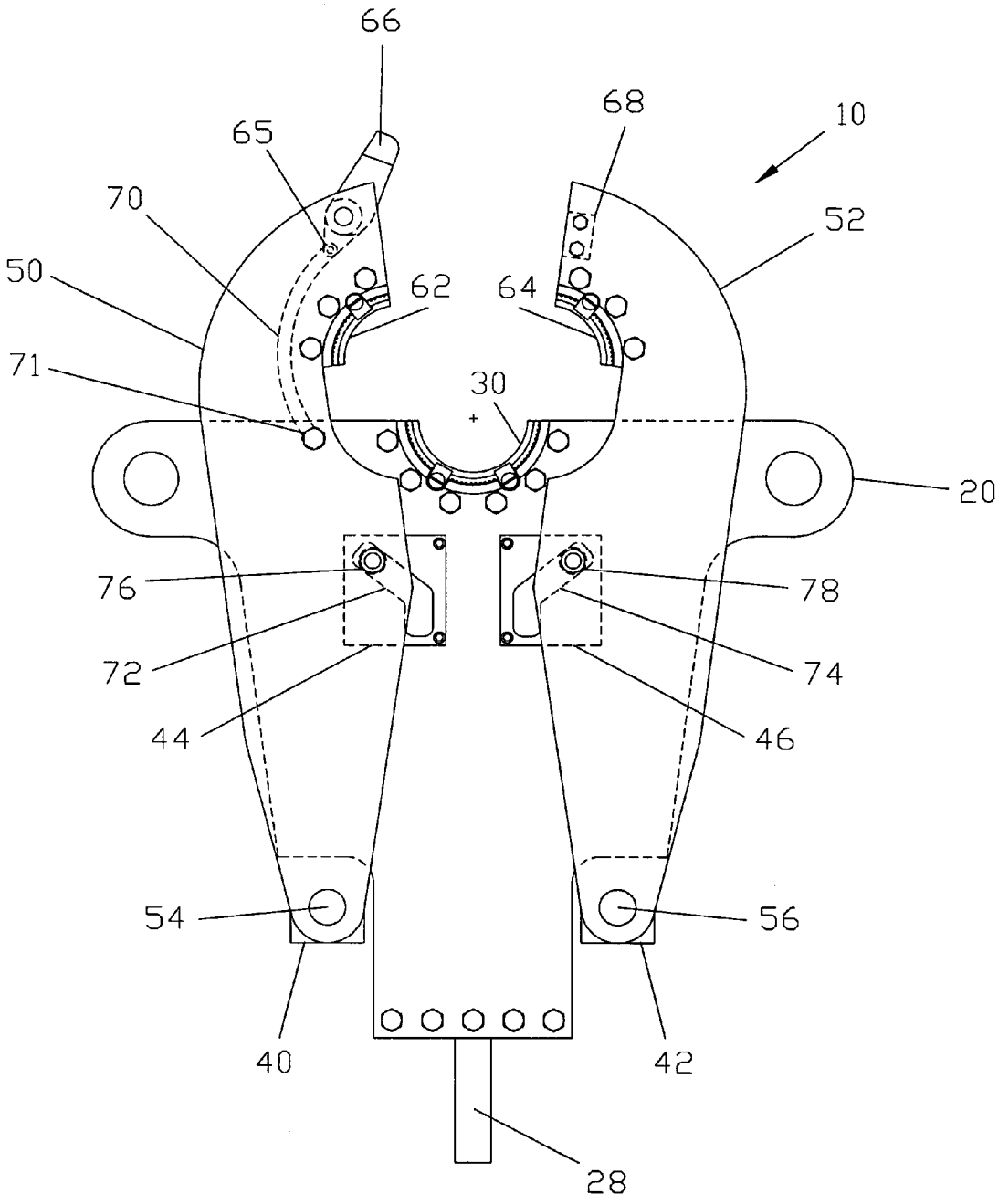
FIG. 3 depicts the swing arms positioned on the backup tong plate, with the swing arms open for receiving a tubular.
Figure 4:
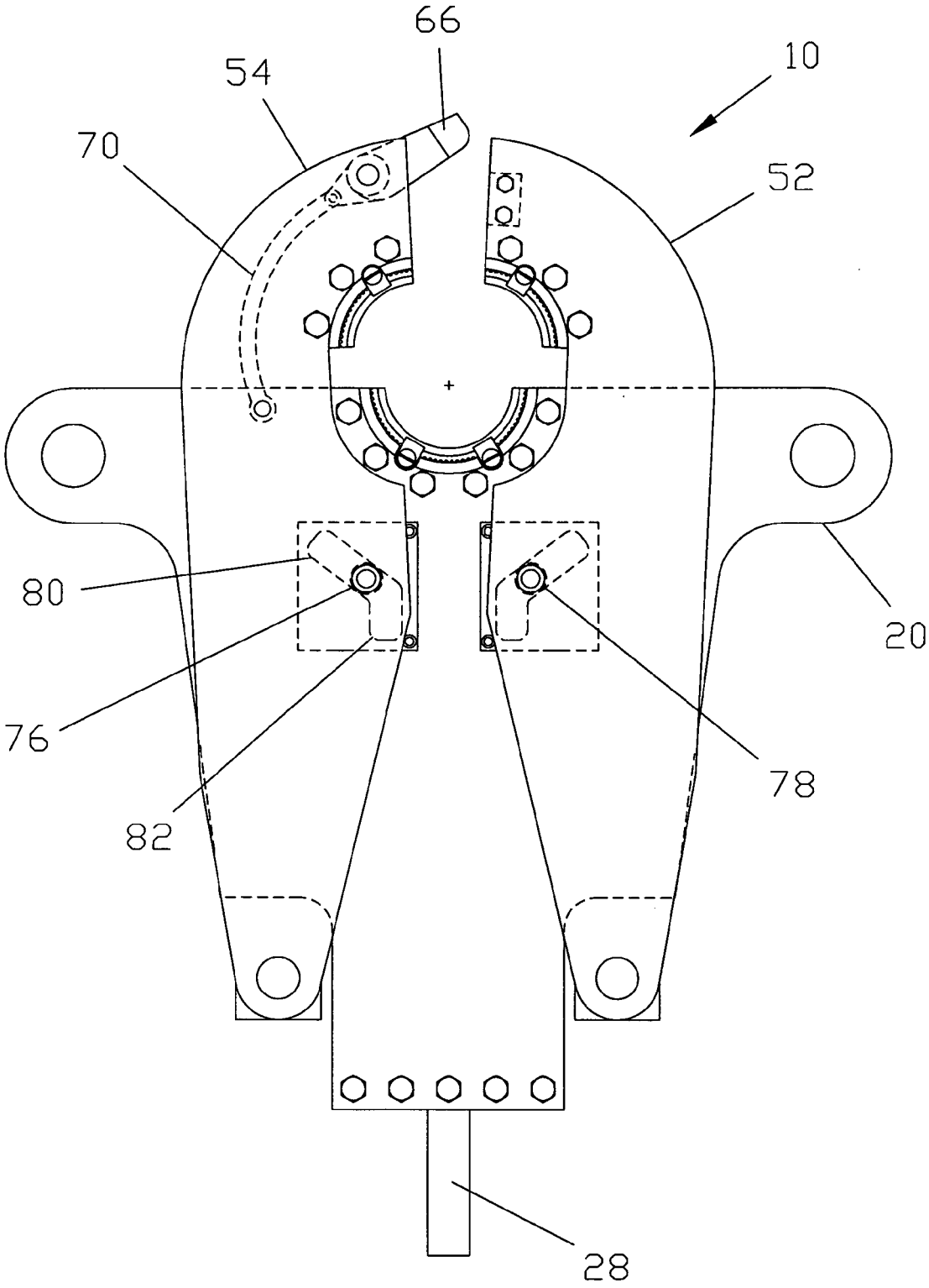
FIG. 4 illustrates the backup tong as shown in FIG. 3, with the cylinders activated to partially close the open throat of the tong.
Figure 5:
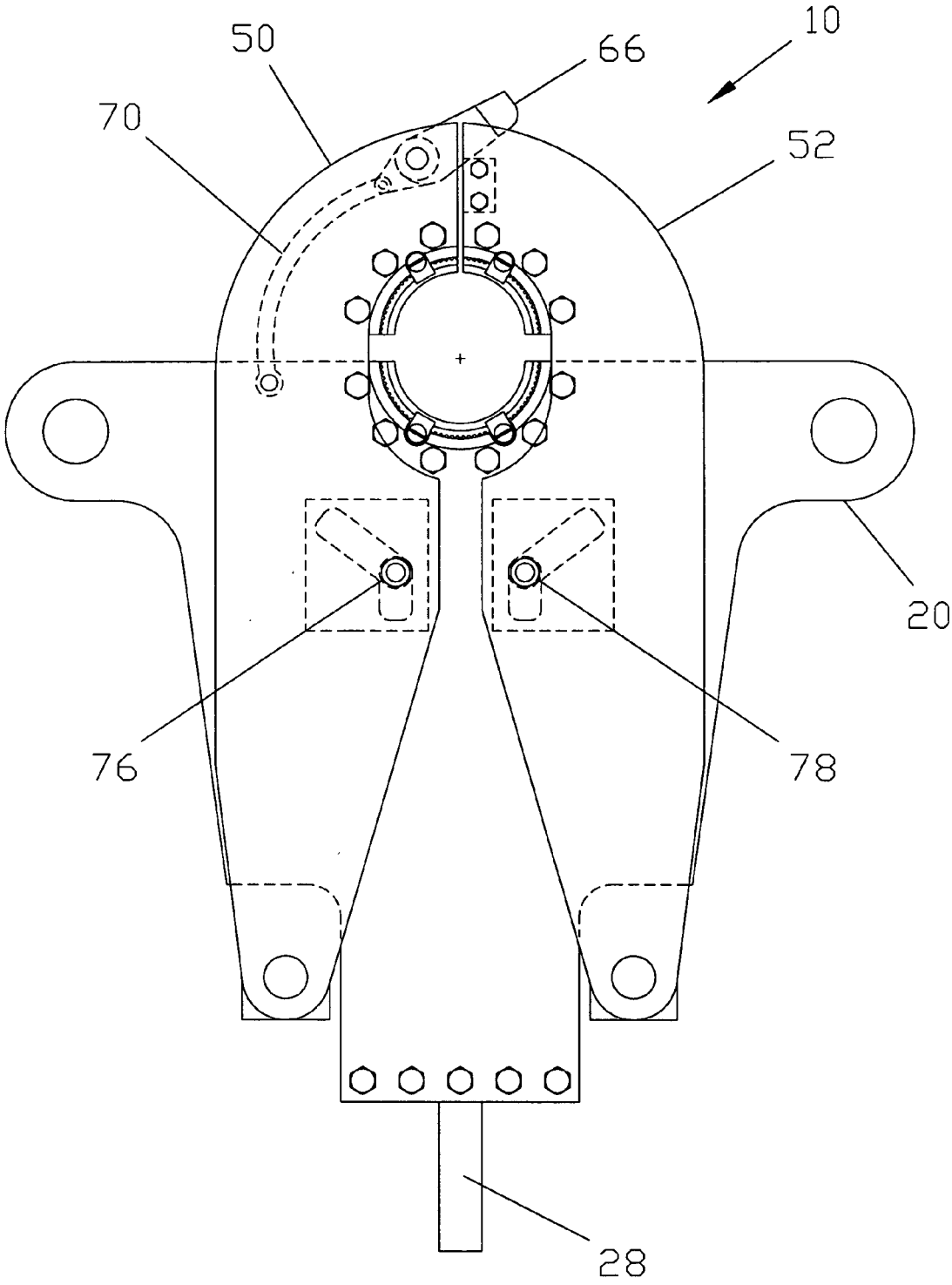
FIG. 5 depicts the backup tong with the throat closed.
Figure 6:
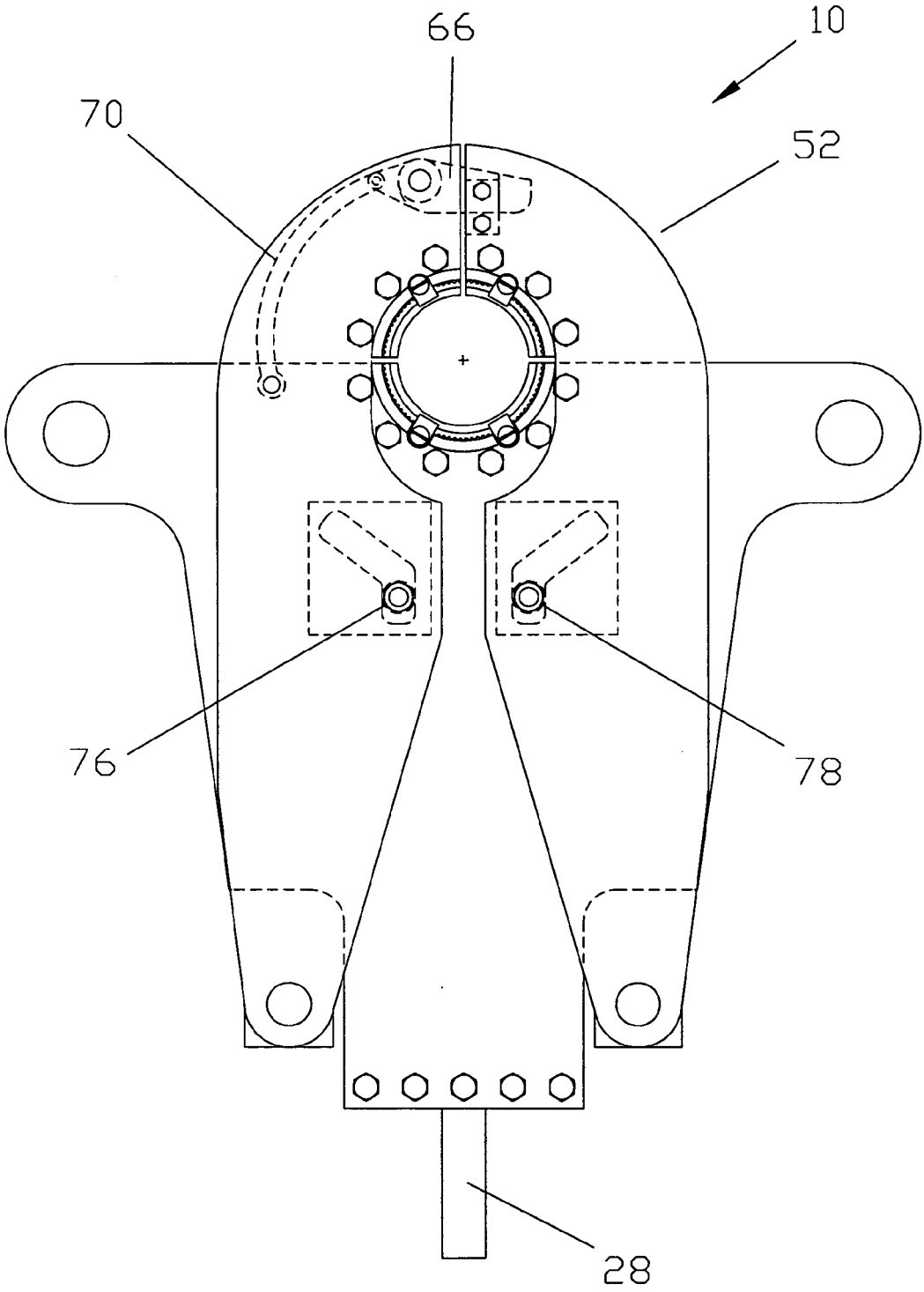
FIG. 6 depicts a backup tong with the dies in gripping engagement with the tubular.

FIG. 3 depicts a complete backup tong 10 according to the present invention, with the swing arms 50, 52 mounted at their respective rearward ends to the rod eyes 40, 42 at the rod end of the hydraulic cylinders. FIG. 3 depicts the tong in a fully opened position, with a very wide throat for receiving large diameter tubulars, and the latch 66 swung open. More particularly, a latch arm 70 is connected at 71 to the swing arm 50, and is connected about pivot 65 to the latch 66. As the cylinders move the swing arms along the centerline of the backup tong, the latch arm will pivot to close the throat between the swing arms, as shown in FIGS. 4–6. Latch block operates to receive latch 66 by fitting within a lateral slot in the latch block.

In a preferred embodiment, the left side and the right side cam plates 44, 46 are each mounted to the tong plate, and have a slot or groove therein for receiving a respective cam powered 76, 78 which is mounted to the respective swing arm. FIG. 3 thus shows the cam followers 76, 78 each at the end of the slots 72, 74, respectively, in the cam plates 44, 46.

For the embodiment depicted, the cam plates are each mounted on the backup tong plate and the cam followers are each mounted on the swing arms. In other embodiments, these components may be reversed so that the left side cam plate and the right side cam plate are each supported on a respective left side and right side swing arm, and a cam follower then mounted on the backup tong plate.

In the FIG. 4 embodiment, the cylinders have been actuated to partially retract, thereby pivoting the latch 66 to a partially closed position, and moving the cam followers along their respective slots in the cam plates. Each slot in the cam plates 44, 46 thus has an angled portion 80 in which the cam follower moves between a throat fully opened position and a throat generally closed position, and a straight section 82 which extends generally parallel to the centerline 22 of the backup tong, and in which the cam follower moves to a fully closed position. Figure 5 thus shows the cam follower 76, 78 at the intersection of the angled slot 80 and the straight slot 82, with the tong being substantially fully closed, and the latch 66 being substantially closed. In the FIG. 6 embodiment, each of the cam followers 76, 78 is moved further in the straight section of the slot and the dies are then moved into full gripping engagement with the tubular.

The gripping heads 62, 64 are thus provided at the forward end of each of the left side arm and the right side swing arm, while head 30 is mounted along the centerline 22 of the backup tong plate. The combination of the gripping head on the backup tong and the gripping heads on the left side and the right side swing arms preferably engage the tubular over a circumferential length of at least 340°, and preferably over a circumferential length of 350° or more. The gripping head on the backup tong plate preferably engages the tubular over a circumferential length of at least 160°, and each gripping head on the forward end of each swing arm engages the tubular over a circumferential length of at least 80°. Each of the gripping heads 62, 64 is thus fixedly supported at the forward end of the respective left side swing arm and the right side swing arm, while the head 30 is similarly fixedly supported on the one or more backup tong plates.

Figure 7:
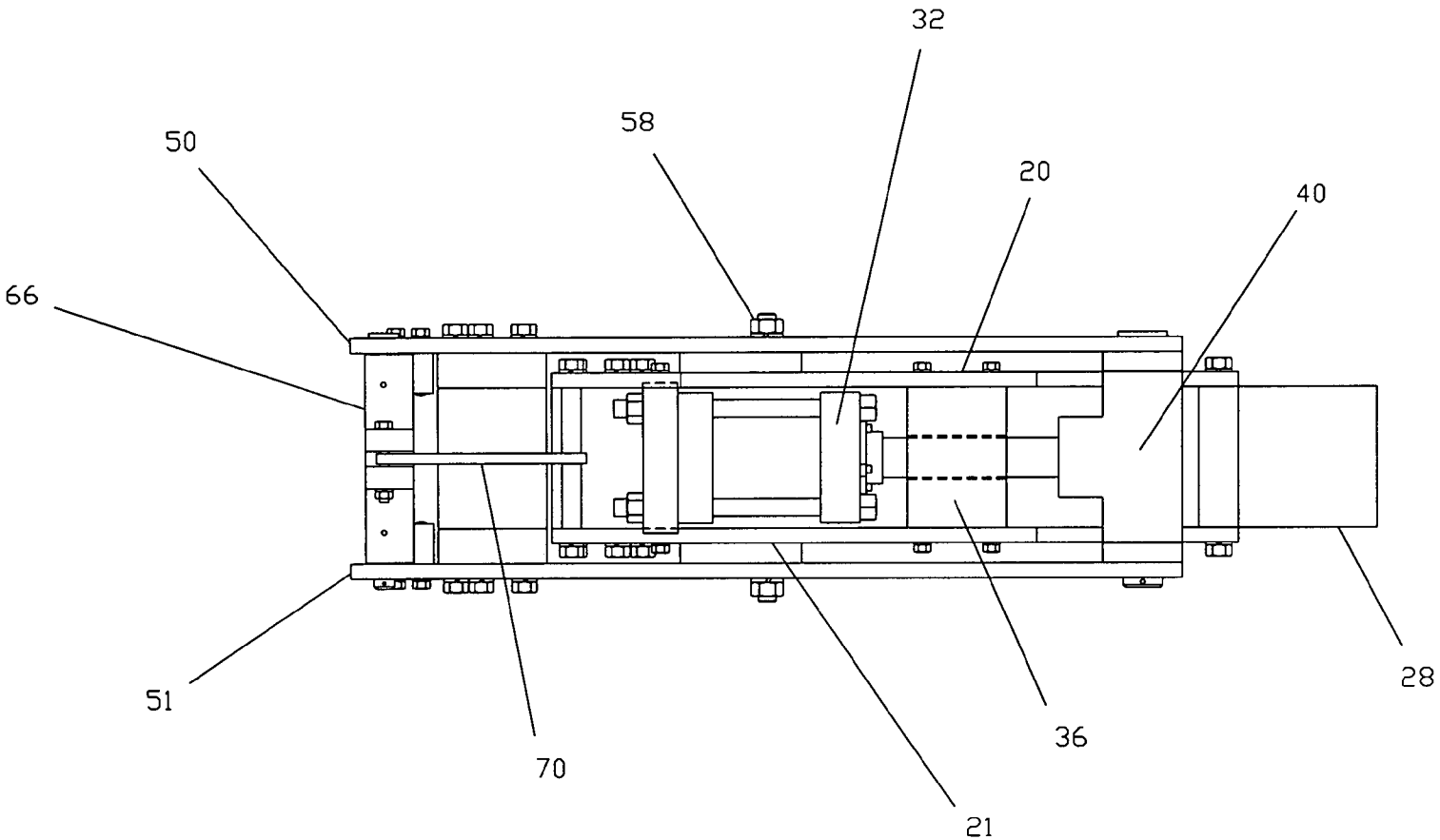
FIG. 7 depicts a side view of the backup tong.

FIG. 7 depicts a side view of the preferred embodiment of a backup tong, and more clearly depicts an upper left side swing arm plate 50 and a lower left side swing arm plate 50, and also depicts the cylinder 32 sandwiched between the top tong plate 20 and the bottom tong plate 21. The cylinder rod support 36 is shown secured to each of the top and bottom tong plates 20, 21 and guides the rod end of the cylinder, which ends in the rod eye 40. FIG. 7 also depicts a latch link 70 which is pivotally connected to the latch 66, which in turn pivotally opens and closes in response to actuation of the cylinders 32, 34.

Figure 8:
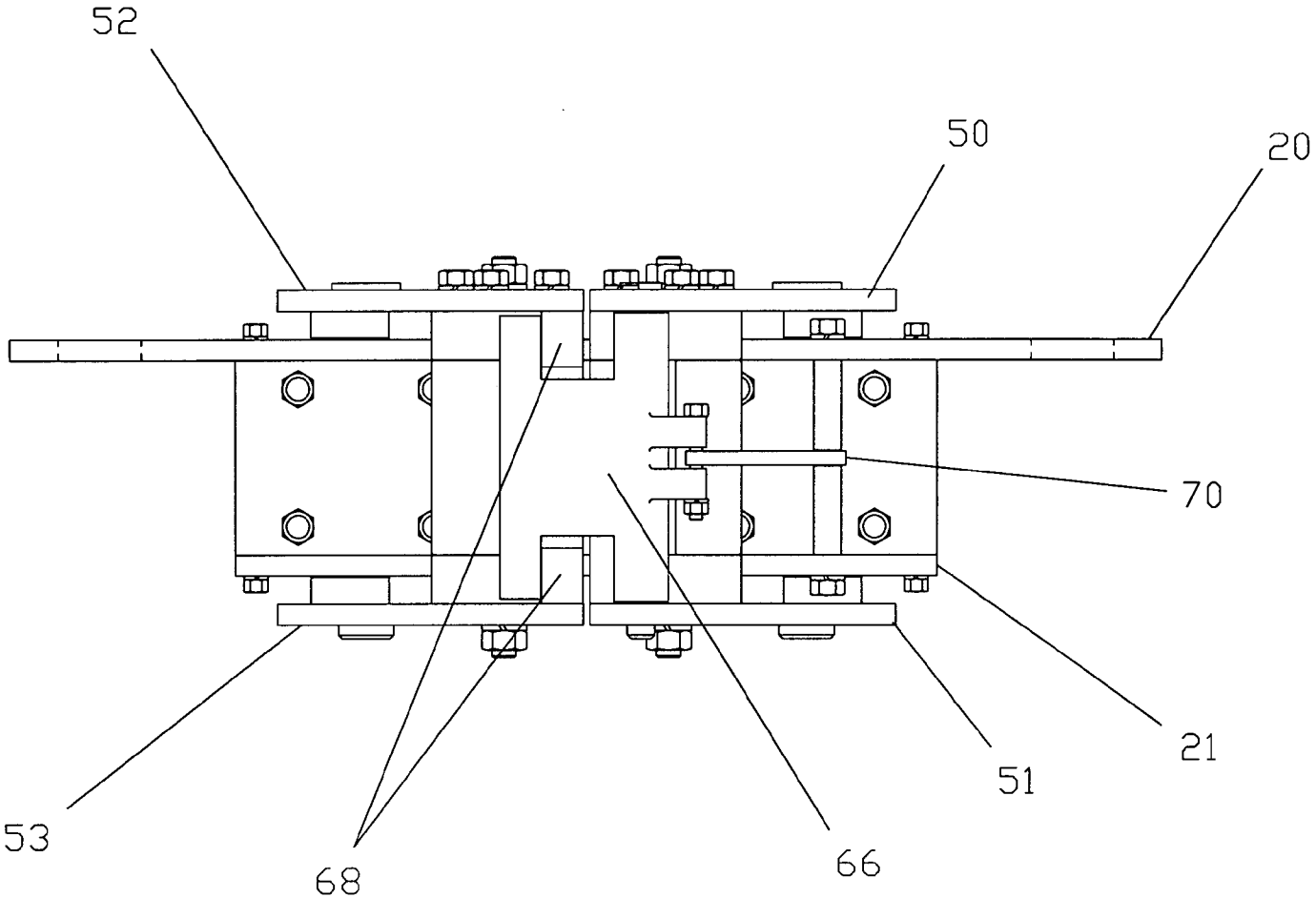
FIG. 8 depicts a front end view of the backup tong.

FIG. 8 is an end view of the backup tong, and more clearly depicts a suitable size for the top backup tong plate 20 relative to the bottom backup tong plate 21, and also depicts both the left side and right side and the top and bottom swing arms 50, 51, 52 and 53. The latch link 70 is shown pivotally connected to the latch arm 66, which cooperates with an upper and a lower latch block 68 to provide a stationery mating surface for the latch to engage and prevent opening or spreading of the forward ends of the swing arms.

Figure 9:
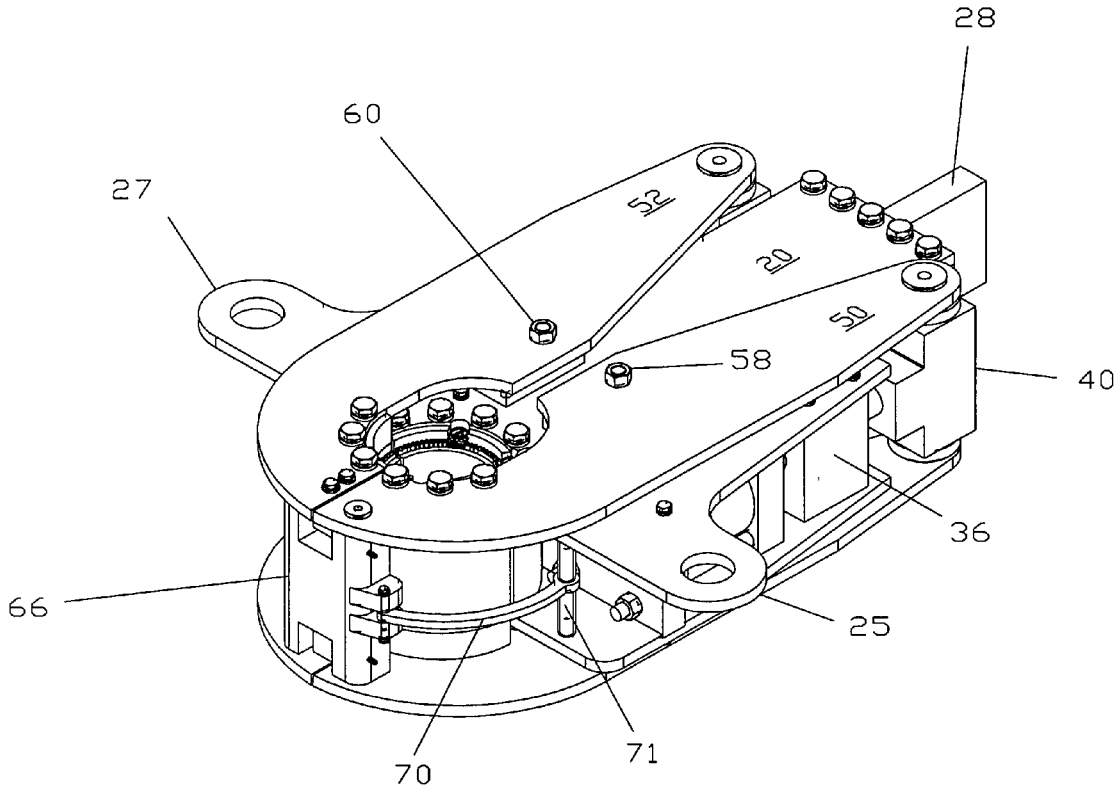
FIG. 9 depicts a pictorial view of the backup tong.

FIG. 9 depicts an assembled backup tong according to the present invention, and shows more clearly the top left side and right side swing plates 50, 52 in the closed position. The pivotal connection between the latch link 70 and pin 71 is also shown, and between the latch link 70 and the latch 66.

The geometry of the backup tong with the swing arms allows for a wider opening of a throat for receiving tubulars of various diameters and also allows for a combination of dies which cover a higher percentage of the circumference of the tubular. A larger circumferential coverage of the tubular aids in preventing crushing of the tubular, and also increases the frictional surface for greater torque restraint without marking the pipe.

By pulling the front dies into the tubular as the cam followers move rearward in the straight section 82, the reactionary forces exerted by the cylinders are concentrated on the rear die 30. This effectively producing an active rear die instead of a passive one common in designs which use pivoting heads. Movement of the dies to grip the tubular also eliminates alignment problems commonly encountered with the backup designs which use pivoting heads to engage small diameter tubulars.

Shorter stroke cylinders may be employed since movement of the dies between the gripping position with the tubular and the release position is very small, since the cam followers move in the direction generally parallel to the centerline of the backup tong.

While preferred embodiments of the present invention have been illustrated in detail, it is apparent that other modifications and adaptations of the preferred embodiments will occur to those skilled in the art. However, it is to be expressly understood that such modifications and adaptations are within the spirit and scope of the present invention, which is defined in the following claims.

What is claimed is:

1. A backup tong for securing a tubular against axial rotation in response to rotation of another tubular by a pipe rotating device, the backup tong comprising:

a backup tong plate supporting a left side fluid powered cylinder, a right side fluid powered cylinder, and a gripping head spaced generally along a centerline of the backup tong plate for gripping the tubular;

a left side swing arm and a right side swing arm each pivotally connected to a respective left side fluid powered cylinder and right side fluid powered cylinder;

a left side cam plate and a right side cam plate each supported on one of the backup tong plate and a respective left side swing arm and right side swing arm;

a left side cam follower and a right side cam follower each supported on the other of the backup tong plate and the respective left side swing arm and right side swing arm for cooperation with the left side cam plate and the right side cam plate, respectively; and a gripping head on a forward end of each of the left side swing arm and the right side swing arm for gripping the tubular.

2. A backup tong as defined in claim 1, wherein the backup tong plate comprises:

an upper backup tong plate and a lower backup tong plate, the left side cylinder and the right side cylinder being positioned between the upper backup tong plate and the lower backup tong plate.

3. A backup tong as defined in claim 1, wherein the left side swing arm and the right side swing arm comprise:

an upper left side swing arm above the backup tong plate; and the lower left side swing arm below the backup tong plate;

an upper right side swing arm above the backup tong plate; and the lower right side swing arm below the backup tong plate.

4. A backup tong as defined in claim 1, further comprising:

a latch arm pivotally connected to the backup tong plate and one of the left side swing arm and right side swing arm; and a latch pivotally connected to the latch arm and the one at the left side swing arm and right side swing arm and movable for opening and closing a space between the left side swing arm and the right side swing arm in response to actuation of the left side hydraulic cylinder and the right side hydraulic cylinder.

5. A backup tong as defined in claim 1, wherein each of the gripping head on the backup tong plate and the gripping heads on the left side and the right side swing arms are formed with aluminum dies.

6. A backup tong as defined in claim 1, wherein each of the gripping heads on the backup tong plate and the gripping heads on the left side and the right side swing arms are formed with dies having a knurled surface.

7. A backup tong as defined in claim 1, wherein a combination of the gripping head on the backup tong plate and the gripping heads on the left side and right side swing arms engage the tubular over a circumferential length of at least 340°.

8. A backup tong as defined in claim 7, wherein the gripping head on the backup tong plate engages the tubular are a circumferential length of at least 160°.

9. A backup tong as defined in claim 8, wherein the gripping heads on each of the left side swing arm and right side swing arm engage the tubular with a circumferential length of at least 80°.

10. A backup tong as defined in claim 1, wherein a rear end of each of the left side hydraulic cylinder and the right side of the hydraulic cylinder is pivotally connected to a rear of a respective left side swing arm and right side swing arm.

11. A backup tong as defined in claim 1, wherein each of the right side cam plate and left side cam plate move the respective left side cam follower and right side cam follower in a direction substantially parallel to the centerline of the backup tong during engagement of the gripping heads on the left side swing arm and the right side swing arm with the tubular.

12. A backup tong as defined in claim 1, wherein the backup tong plate includes a left side through aperture and a right side through aperture for receiving a respective left side post and right side post extending downward from a power tong.

13. A method for securing a tubular against axial rotation in response to rotation of another tubular by a pipe rotating device, the method comprising:

supporting a left side fluid powered cylinder, a right side fluid powered cylinder, and a gripping head on a backup tong plate, the gripping head spaced generally along a centerline of the backup tong plate for gripping the tubular;

pivotally connecting a left side swing arm and a right side swing arm to a respective left side fluid powered cylinder and right side fluid powered cylinder;

supporting a left side cam plate and a right side cam plate each on one of the backup tong plate and a respective left side swing arm and right side swing arm;

supporting a left side cam follower and a right side cam follower each on the other of the backup tong plate and the respective left side swing arm and right side swing arm for cooperation with the left side cam plate and the right side cam plate, respectively; and positioning a gripping head on a forward end of each of the left side swing arm and the right side swing arm for gripping the tubular.

14. A method as defined in claim 13, wherein the left side cylinder and the right side cylinder are each positioned between an upper backup tong plate and a lower backup tong plate.

15. A method as defined in claim 13, wherein:

an upper left side swing arm is positioned above the backup tong plate; and the lower left side swing arm is positioned below the backup tong plate;

an upper right side swing arm is positioned above the backup tong plate; and the lower right side swing arm is positioned below the backup tong plate.

16. A method as defined in claim 13, further comprising:

pivotally connecting a latch arm to the backup tong plate and to one of the left side swing arm and right side swing arm; and pivotally connecting a latch to the latch arm and the one at the left side swing arm and right side swing arm, the latch being movable for opening and closing a space between the left side swing arm and the right side swing arm in response to actuation of the left side hydraulic cylinder and the right side hydraulic cylinder.

17. A method as defined in claim 13, wherein a combination of the gripping head on the backup tong plate and the gripping heads on the left side and right side swing arms engage the tubular over a circumferential length of at least 340°.

18. A method as defined in claim 13, wherein a rear end of each of the left side hydraulic cylinder and the right side of the hydraulic cylinder is pivotally connected to a rear of a respective left side swing arm and right side swing arm.

19. A method as defined in claim 13, wherein each of the right side cam plate and left side cam plate move the respective left side cam follower and right side cam follower in a direction substantially parallel to the centerline of the backup tong during engagement of the gripping heads on the left side swing arm and the right side swing arm with the tubular.

20. A method as defined in claim 13, wherein the backup tong plate includes a left side through aperture and a right side through aperture for receiving a respective left side post and right side post extending downward from a power tong.

* * * * *